US007471250B2

(12) United States Patent
Yoon et al.

(10) Patent No.: US 7,471,250 B2
(45) Date of Patent: Dec. 30, 2008

(54) INTENNA-TYPE DIPOLE ANTENNA FOR RECEIVING BROADCAST SIGNALS IN VHF BAND

(75) Inventors: Ick-jae Yoon, Yongin-si (KR); Young-eil Kim, Yongin-si (KR); Yong-jin Kim, Yongin-si (KR)

(73) Assignees: Samsung Electronics Co., Ltd., Suwon-si (KR); Samsung Electro-Mechanics Co., Ltd, Suwon-si (KR)

( * ) Notice: Subject to any disclaimer, the term of this patent is extended or adjusted under 35 U.S.C. 154(b) by 47 days.

(21) Appl. No.: 11/606,052

(22) Filed: Nov. 30, 2006

(65) Prior Publication Data

US 2007/0290933 A1 Dec. 20, 2007

(30) Foreign Application Priority Data

Jun. 14, 2006 (KR) ..... 10-2006-0053518

(51) Int. Cl.
*H01Q 1/24* (2006.01)

(52) U.S. Cl. ..... 343/702; 343/725; 343/846

(58) Field of Classification Search ..... 343/702, 343/700 MS, 794, 795, 846; 455/575.1, 455/575.5

See application file for complete search history.

(56) References Cited

U.S. PATENT DOCUMENTS 6,745,057 B1 * 6/2004 Hankui ..... 455/575.5
6,990,363 B2 * 1/2006 Ito et al. ..... 455/575.5

FOREIGN PATENT DOCUMENTS

KR 10-2004-0000535 A 1/2004

* cited by examiner

*Primary Examiner*—Hoang V Nguyen
(74) *Attorney, Agent, or Firm*—Sughrue Mion, PLLC

(57) ABSTRACT

An intenna-type dipole antenna of a mobile terminal, for receiving a broadcast signal in a very high frequency (VHF) band, includes: a conducting plate which functions as one of a radiator and a ground; and a pole which functions as the other of the radiator and the ground. Accordingly, the dipole antenna can be implemented as an intenna with facilitated installation and low costs.

16 Claims, 4 Drawing Sheets

INTENNA-TYPE DIPOLE ANTENNA FOR RECEIVING BROADCAST SIGNALS IN VHF BAND

CROSS-REFERENCE TO RELATED APPLICATIONS

This application claims priority from Korean Patent Application No. 10-2006-53518 filed Jun. 14, 2006, in the Korean Intellectual Property Office, the disclosure of which is incorporated herein by reference.

BACKGROUND OF THE INVENTION

1. Field of the Invention

Apparatuses consistent with the present invention relate to an intenna-type dipole antenna for receiving broadcast signals in a very high frequency (VHF) band, and more particularly, to an intenna-type dipole antenna which is mounted as the intenna to receive broadcast signals in a VHF band.

2. Description of the Related Art

With advances in mobile communication technologies, wireless terminals are providing various services that have been available only in limited places such as home or offices.

Among those services, recently, much attention is paid to digital multimedia broadcasting (DMB) or digital video broadcasting-handheld (DVB-H) which receives and services broadcast signals in a very high frequency (VHF) band.

The DMB service or the DVB-H service, which is a mobile multimedia broadcast service of new idea with convergence of communicating and broadcasting, enables the viewing of broadcast programs in the VHF band through wireless terminals.

The DMB service is provided through wireless mobile terminals such as a dedicated DMB terminal, a notebook computer, a mobile phone terminal, a vehicle mounted terminal, a personal digital assistant (PDA), a portable multimedia player (PMP), and the like. The DMB service is classified into a satellite DMB service and a terrestrial DMB service. The terrestrial DMB service uses a frequency band of 176-212 MHz, and the satellite DMB service uses a S-band of 2.630-2.655 GHz which is higher than the terrestrial DMB band.

Typically, a length of a dipole antenna is $\lambda/2$ and that of a monopole antenna is $\lambda/4$. Accordingly, the higher a frequency band is, the shorter an antenna is, and the lower a frequency band is, the longer an antenna is. Since the terrestrial DMB service uses the VHF band commonly used for broadcasting, it needs a longer antenna than the satellite DMB service and the same antenna size as the TV antenna in theory. Hence, the terrestrial DMB service requires the antenna length above about 30 cm. When the antenna output is high, the length of the antenna may be shorter.

The terrestrial DMB has very small output of about 1-2 KW because it uses taboo channels 8, 10 and 12. Since the channel 8, which is between the channel 7 and the channel 9, causes radio interference to the neighboring channels when its output is increased, it is hard to raise the output of the channel 8. However, when such an antenna is mounted in a wireless terminal which features portability and mobility, it is inconvenient to use a longer antenna.

Thus, the most urgent task to antenna developers is to shorten the length of the terrestrial DMB antenna while the reception sensitivity is maintained. It is known that it is almost impossible to implement the terrestrial DMB antenna below 15 cm in length up to now.

In the mean time, the DVB-H, based on digital video broadcasting-terrestrial (DVB-T) developed and adapted for digital TV broadcast standard primarily in Europe, is one of the DVBs taking account of low power, mobility, and portability of mobile phones or portable video devices. As the DVB-H utilizes a relatively low frequency band, it may face the same problems as the terrestrial DMB antenna.

Therefore, it is demanded to develop an antenna that can be embedded in a device as an intenna to receive signals in the VHF band used mostly for the terrestrial DMB service or the DVB-H service.

SUMMARY OF THE INVENTION

Exemplary embodiments of the present invention address the above aspects and other aspects not described above. The present invention is not required to overcome the aspects described above, and an exemplary embodiment of the present invention may not overcome any of the aspects described above.

The present provides an intenna-type dipole antenna mounted as an intenna for receiving broadcast signals in the VHF band.

According to an aspect of the present invention, there is provided an intenna-type dipole antenna of a mobile terminal, for receiving broadcast signals in a very high frequency (VHF) band, includes a conducting plate which functions as one of a radiator and a ground; and a pole which functions as the other of the radiator and the ground.

The conducting plate may function as the radiator and the pole may function as the ground.

The conducting plate may function as the ground and the pole may function as the radiator.

The intenna-type dipole antenna may further include a connector which includes a signal line and a ground plate. The conducting plate and the pole respectively may be coupled to one of the signal line and the ground plate.

The conducting plate may be at least one of a common electrode and a pixel electrode, which supplies power to a liquid crystal display (LCD) panel of the mobile terminal.

The pole may be formed of a wire.

The conducting plate and the pole may be bent from each other at a certain angle centering on the connector.

The mobile terminal may be at least one of a dedicated digital multimedia broadcasting (DMB) or digital video broadcasting-handheld (DVB-H) terminal, a notebook computer, a mobile phone terminal, a vehicle mounted terminal, a personal digital assistance (PDA), and a portable multimedia player (PMP).

The mobile terminal may be the notebook computer, the conducting plate may be mounted on a LCD panel of a notebook computer, and the pole may be mounted on a main body of the notebook computer.

The conducting plate may be a circuit board which is mounted on the main body of the mobile terminal.

According to another aspect of the present invention, an intenna-type dipole antenna for receiving broadcast signals in a VHF band includes a connector which includes signal line and a ground plate; a conducting plate which is coupled to one of the signal line and the ground plate; and a pole which is coupled to the other of the signal line and the ground plate.

BRIEF DESCRIPTION OF THE DRAWING FIGURES

These and/or other aspects of the present invention will become more apparent and more readily appreciated from the following description of exemplary embodiments thereof, with reference to the accompanying drawings, in which.

Figure 4A:
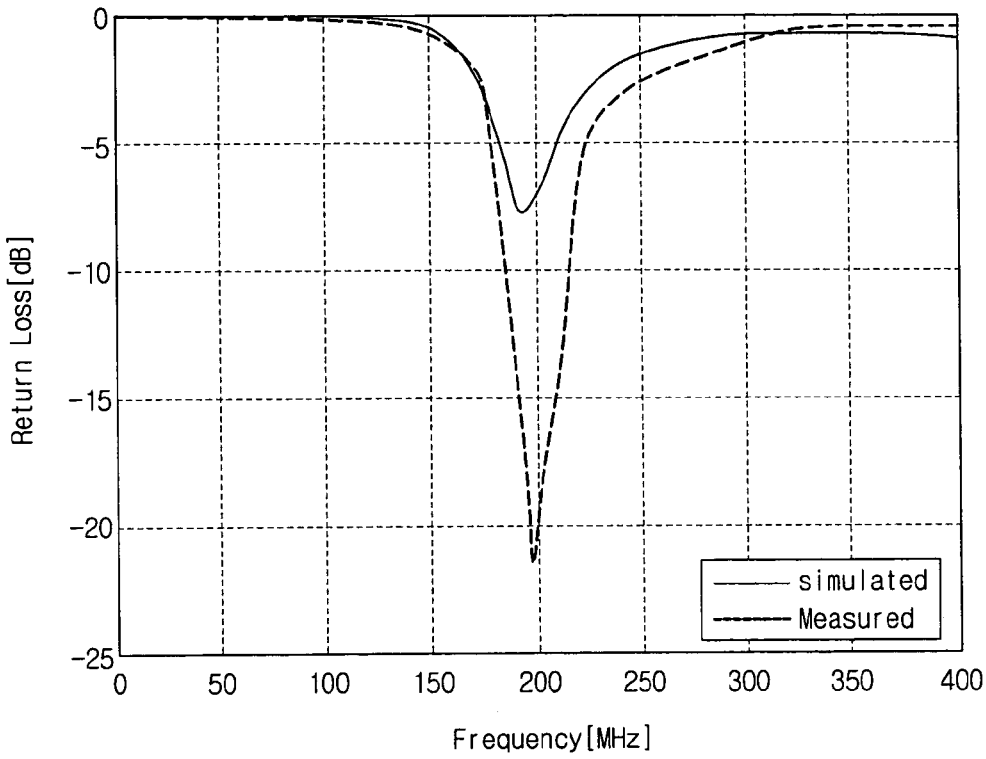
Figure 4B:
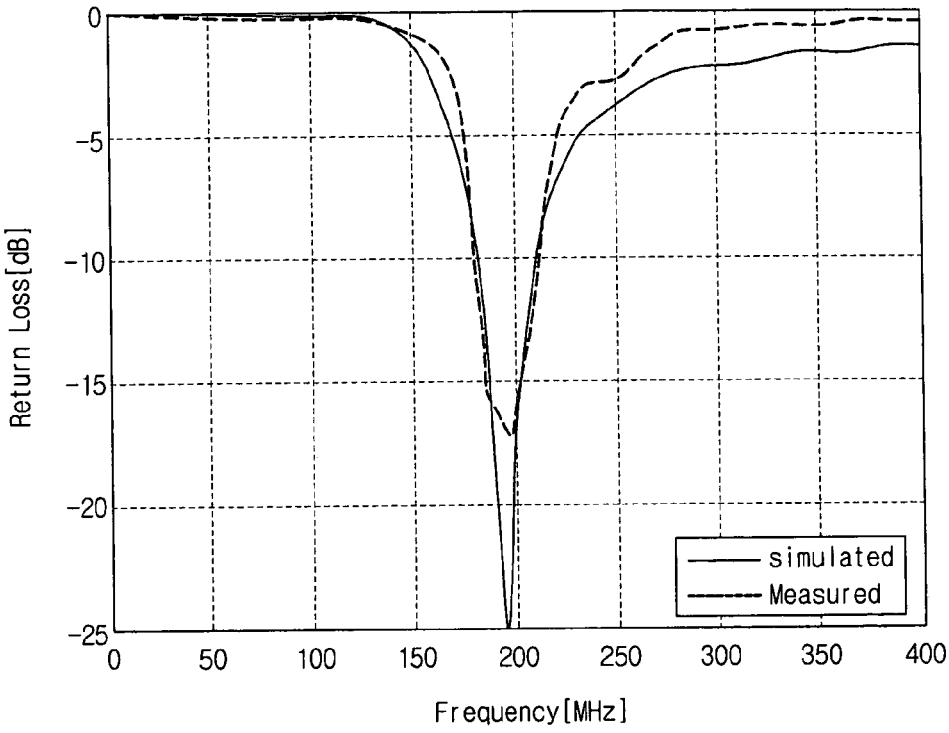

FIG. 4A is a graph showing a return loss when the main body and the cover of the notebook computer having the dipole antenna are unfolded according to an exemplary embodiment of the present invention; and FIG. 4B is a graph showing a return loss when the cover of the notebook computer having the dipole antenna is rotated at a certain angle against the main body according to an exemplary embodiment of the present invention.

DETAILED DESCRIPTION OF THE EXEMPLARY EMBODIMENTS

Certain exemplary embodiments of the present invention will now be described in greater detail with reference to the accompanying drawings.

In the following description, the same drawing reference numerals are used to refer to the same elements, even in different drawings. The matters defined in the following description, such as detailed construction and element descriptions, are provided as examples to assist in a comprehensive understanding of the invention. Also, well-known functions or constructions are not described in detail, since they would obscure the invention in unnecessary detail.

An intenna-type dipole antenna according to exemplary embodiments of the present invention can be embedded in a mobile wireless terminal such as a dedicated DMB or DVB-H terminal, a notebook computer, a mobile phone terminal, a vehicle mounted terminal, a PDA, a PMP, and the like. In the following explanation, a notebook computer is exemplified for understanding.

Figure 1A:
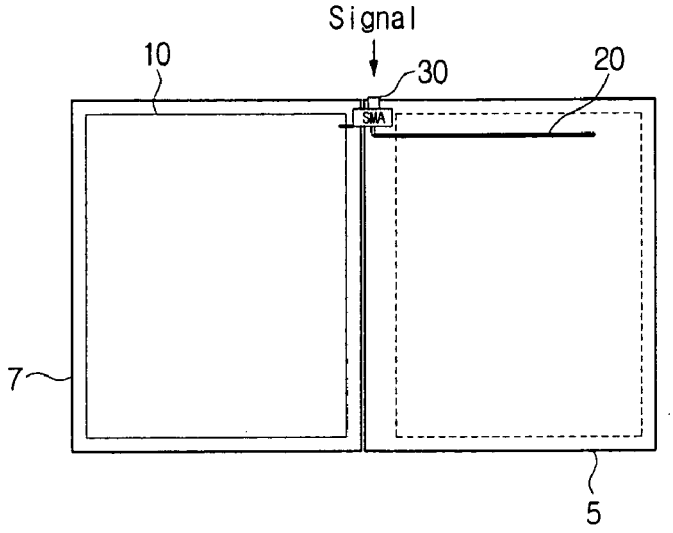
FIG. 1A is a simplified diagram of an intenna-type dipole antenna according to an exemplary embodiment of the present invention.
Figure 1B:
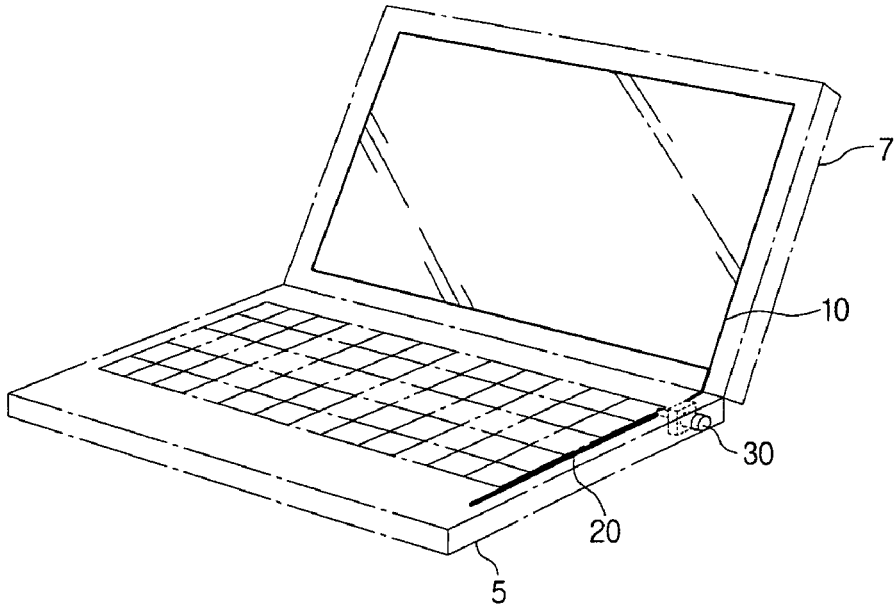
FIG. 1B is a perspective view of a notebook computer to which the dipole antenna of FIG. 1A is mounted according to an exemplary embodiment of the present invention.

FIG. 1A is a simplified diagram of an intenna-type dipole antenna according to one exemplary embodiment of the present invention, and FIG. 1B is a perspective view of a notebook computer to which the dipole antenna of FIG. 1A is mounted.

The intenna-type dipole antenna includes a conducting plate 10, a pole 20, and a connector 30.

Figure 3:
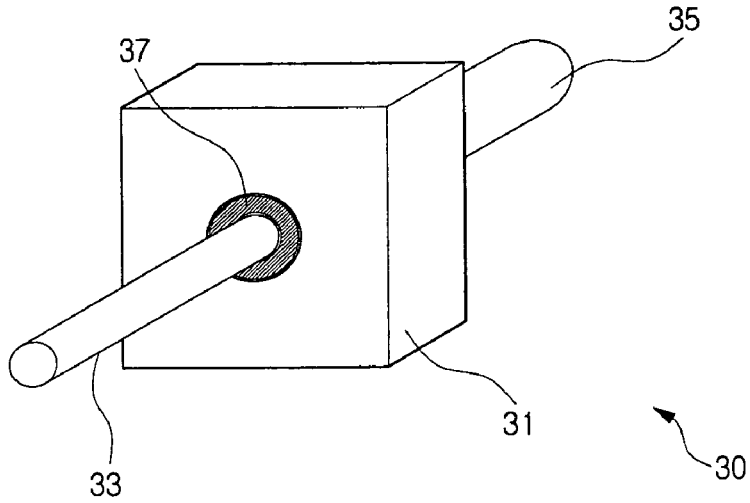
FIG. 3 is a perspective view of a connector used in the exemplary embodiment of the present invention according to an exemplary embodiment of the present invention.

The connector 30 employs a SubMiniature version A (SMA) connector. The connector 30 includes a hexahedral ground plate 31 and a signal line 33 penetrating and connecting the center part of the ground plate 31 as shown in FIG. 3. Centering on the ground plate 31, an RF cable 35 is connected to the external signal line 33 of the connecter 30, and the conducting plate 10 or the pole 20 is connected to the internal signal line 33 of the connector 30. A dielectric material 37 such as Teflon fills up around the signal line 33 in the areas where the signal line 33 penetrates the ground plate 31 in order to prevent the electrical connection between the signal line 33 and the ground.

The connector 30 is mounted on a main body 5 or a cover 7 of the notebook computer to connect the conducting plate 10 with the pole 20. When the ground plate 31 of the connector 30 is connected with the conducting plate 10, the conducting plate 10 serves as the ground. When the ground plate 31 of the connector 30 is connected with the pole 20, the pole 20 serves as the ground.

The conducting plate 10 is an electrode plate for supplying power to a liquid crystal display (LCD) panel mounted on a dedicated DMB or DVB-H terminal, a notebook computer, a mobile phone terminal, a vehicle mounted terminal, a PDA, a PMP, and the like. Typically, the LCD panel has a common electrode, called indium-tin-oxide (ITO), and a pixel electrode for each pixel. Hence, either the common electrode or the pixel electrode can be used as the conducting plate 10 without having to install an additional conducting plate.

The pole 20 is formed by coating a conductor of a bar shape, such as wire. The pole 20 is installed on the main body 5 of the notebook computer.

In the dipole antenna, according to whether the conducting plate 10 and the pole 20 are connected to the ground plate 31 or the signal line 33 of the SMA connector 30, the conducting plate 10 can serve as the ground and the pole 20 can serve as the radiator, or the conducing plate 10 can serve as the radiator and the pole 20 can serve as the ground.

In the dipole antenna shown in FIG, 1A, the conducting plate 10 is coupled to the ground plate 31 of the connector 30 and the pole 20 is coupled to the signal line 33 of the connector 30. Accordingly, the conducting plate 10 serves as the ground and the pole 20 serves as the radiator.

Figure 2:
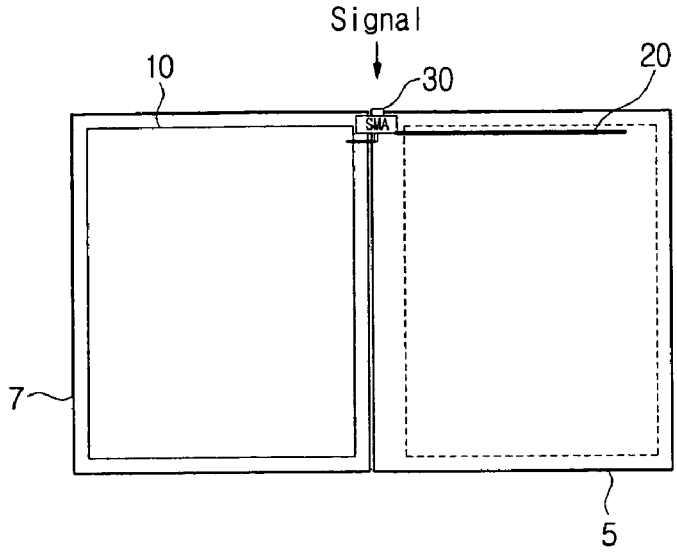
FIG. 2 is a simplified diagram of an intenna-type dipole antenna according to another exemplary embodiment of the present invention.

By contrast, in the dipole antenna as shown in FIG. 2, the conducting plate 10 is coupled to the signal line 33 of the connector and the pole 20 is coupled to the ground plate 31 of the connector 30. Hence, the conducting plate 10 functions as the radiator and the pole 20 functions as the ground.

While the notebook computer having the dipole antenna is used with the cover 7 rotated from the main body 5 at a certain angle, the conducting plate 10 is bent from the pole 20 at a certain angle in accordance with the angle of the cover 7. In other words, the antenna is operable only when the intended return loss is acquired with the intended width in the frequency band when the conducting plate 10 and the pole 20 are arranged at the certain angle.

FIG. 4A is a graph showing the return loss when the main body 5 and the cover 7 of the notebook computer having the dipole antenna are unfolded according to an exemplary embodiment of the present invention, and FIG. 4B is a graph showing the return loss when the cover 7 of the notebook computer having the dipole antenna is rotated at a certain angle against the main body 5 according to an exemplary embodiment of the present invention.

As shown in FIG. 4A, as one can see, the actual return loss measured when the main body 5 and the cover 7 of the notebook computer are unfolded generates its operating frequency at about 200 MHz. The bandwidth of the operating frequency is about 40 MHz at −10 dB. Thus, the dipole antenna is able to receive broadcast signals in the VHF band while the main body 5 and the cover 7 of the notebook computer are unfolded.

Referring now to FIG. 4B, the actual return loss measured when the cover 7 of the notebook computer is rotated from the main body 5 generates its operating frequency at about 200 MHz. The bandwidth of the operating frequency is about 40 MHz at −10 dB. Thus, the dipole antenna is able to receive broadcast signals when the cover 7 of the notebook computer is rotated from the main body 5, that is, when the notebook computer is normally used. Particularly, the dipole antenna shows its optimal applications for the DMB service or the DVB-H service which uses the frequency band of 176-212 MHz.

As such, the dipole antenna includes the conducting plate 10, which employs the electrode plate of the LCD panel of the mobile terminal, and the pole 20. That is, by constituting the antenna radiator using the existing structure of the mobile terminal, the dipole antenna can be implemented as an internal antenna, compared with a related art external antenna. Also, since merely the connector 30 and the pole 20 are mounted, the installation is facilitated and the dipole antenna is low-priced. Furthermore, the dipole antenna is quite advantageous to the reception of the broadcast signals thanks to the omni-directionality of the radiation pattern.

In the mean time, the conducting plate 10 employs the electrode plate of the LCD panel in the exemplary embodiments of the present invention. It should be appreciated that the conducting plate 10 can employ a ground generated on the circuit board of the mobile terminal. In this case, as the circuit board is installed on the main body 5, the pole 20 can be mounted on the cover 7.

As set forth above, the dipole antenna can be implemented as an intenna with facilitated installation and low costs.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An intenna-type dipole antenna of a mobile terminal, for receiving a broadcast signal in a very high frequency (VHF) band, comprising:

a conducting plate which functions as one of a radiator and a ground;

a pole which functions as the other of the radiator and the ground; and a connector which comprises a signal line and a ground plate, wherein the conducting plate is coupled to one of the signal line and the ground plate and the pole is connected to the other of the signal line and the ground plate, respectively.

2. The intenna-type dipole antenna of claim 1, wherein the conducting plate functions as the radiator and the pole functions as the ground.

3. The intenna-type dipole antenna of claim 1, wherein the conducting plate functions as the ground and the pole functions as the radiator.

4. The intenna-type dipole antenna of claim 1, wherein the conducting plate is at least one of a common electrode and a pixel electrode, which supplies power to a liquid crystal display (LCD) panel of the mobile terminal.

5. The intenna-type dipole antenna of claim 1, wherein the pole comprises a wire.

6. The intenna-type dipole antenna of claim 1, wherein the conducting plate and the pole are bent from each other at a certain angle centering on the connector.

7. The intenna-type dipole antenna of claim 1, wherein the mobile terminal is at least one of a dedicated digital multimedia broadcasting (DMB) or digital video broadcasting-handheld (DVB-H) terminal, a notebook computer, a mobile phone terminal, a vehicle mounted terminal, a personal digital assistance (PDA), and a portable multimedia player (PMP).

8. The intenna-type dipole antenna of claim 1, wherein the mobile terminal is a notebook computer, the conducting plate is disposed in a liquid crystal display (LCD) panel of the notebook computer, and the pole is disposed in a main body of the notebook computer.

9. The intenna-type dipole antenna of claim 1, wherein the conducting plate is a circuit board which is disposed in a main body of the mobile terminal.

10. An intenna-type dipole antenna for receiving broadcast signals in a very high frequency (VHF) band, comprising:

a connector which comprises a signal line and a ground plate;

a conducting plate which is coupled to one of the signal line and the ground plate; and a pole which is coupled to another one of the signal line and the ground plate.

11. The intenna-type dipole antenna of claim 10, wherein when the conducting plate functions as the radiator, the pole functions as the ground, and wherein when the conducting plate functions as the ground, the pole functions as the radiator.

12. The intenna-type dipole antenna of claim 10, wherein the pole comprises a wire.

13. The intenna-type dipole antenna of claim 10, wherein the conducting plate and the pole are bent from each other at a certain angle centering on the connector.

14. An intenna-type dipole antenna of a mobile terminal, for receiving a broadcast signal in a very high frequency (VHF) band, comprising:

a conducting plate which functions as one of a radiator and a ground; and a pole which functions as the other of the radiator and the pound, wherein the conducting plate is at least one of a common electrode and a pixel electrode, which supplies power to a liquid crystal display (LCD) panel of the mobile terminal.

15. An intenna-type dipole antenna of a mobile terminal, for receiving a broadcast signal in a very high frequency (VHF) band, comprising:

a conducting plate which functions as one of a radiator and a ground; and a pole which functions as the other of the radiator and the ground, wherein the mobile terminal is a notebook computer, the conducting plate is disposed in a liquid crystal display (LCD) panel of the notebook computer, and the pole is disposed in a main body of the notebook computer.

16. An intenna-type dipole antenna of a mobile terminal, for receiving a broadcast signal in a very high frequency (VHF) band, comprising:

a conducting plate which functions selectively as one of a radiator and a ground; and a pole which functions selectively as the other of the radiator and the ground, wherein if the conducting plate functions as the radiator, the pole functions as the ground, and wherein if the conducting plate functions as the ground, the pole functions as the radiator.

* * * * *